United States Patent [19]

Gillespie

[11] Patent Number: 4,892,046

[45] Date of Patent: Jan. 9, 1990

[54] FURNACE ROOF AND METHOD OF CONSTRUCTING THE SAME

[75] Inventor: John R. Gillespie, Ballwin, Mo.

[73] Assignee: Gillespie & Powers, Inc., St. Louis, Mo.

[21] Appl. No.: 115,167

[22] Filed: Oct. 30, 1987

[51] Int. Cl.[4] ..... F23M 5/06

[52] U.S. Cl. ..... 110/332; 110/331; 52/743; 52/127.1; 126/343.5 R; 126/343.5 A

[58] Field of Search ..... 126/116 B, 343.5 R, 126/343.5 A; 110/331, 332, 336, 341, 349, 339; 52/127.1, 127.2, 127.5, 745, DIG. 1, 741, 743

[56] References Cited

U.S. PATENT DOCUMENTS

| | | | |
|---|---|---|---|
| 2,657,651 | 11/1953 | Forsyth | 110/339 |
| 2,819,693 | 1/1958 | Rath | 110/339 |
| 3,068,813 | 12/1962 | Walt | 110/339 |
| 3,877,402 | 4/1975 | Palazzo | 110/332 |

OTHER PUBLICATIONS

Blue Print drawings sheets G1, G4 and G5, Gillespie & Powers' Inc., 10-24-84, 10-21-84, 10-17-84.

*Primary Examiner*—Larry Jones

*Attorney, Agent, or Firm*—Gravely, Lieder & Woodruff

[57] ABSTRACT

A removable roof for a furnace in which metal is melted has a framework composed of a series of horizontal beams arranged in several layers, with the beams of the lowest layer being parallel to each other and being held in fixed and determined relation with respect to each other by the beams of the next layer. Anchors are attached to the beams of the lowest level, and a cast refractory fills the spaces between and around the anchors so that the refractory forms the downwardly presented face of the roof—the face which is exposed to the interior of the containment vessel. To construct the roof, the framework is fabricated and placed over a horizontal surface, whereupon the anchors are attached and a moldable refractory mix is introduced with the spaces between the anchors. The mix sets up into the refractory.

21 Claims, 2 Drawing Sheets

FURNACE ROOF AND METHOD OF CONSTRUCTING THE SAME

BACKGROUND OF THE INVENTION

This invention relates in general to furnances for melting metal and more particularly to a removable roof for such a furnace, a furnace having such a roof, and the process for constructing the roof.

Aluminum and its alloys melt at a relatively low temperature and therefore lend themselves to casting and recycling. Indeed, a variety of furnaces exist for melting aluminum. In one type of furnace, the entire roof may be removed, and indeed is temporarily displaced to the side of the furnace when the furnace is charged. This of course reduces the time for charging.

The typical removable roof for a melting furnace of that variety is constructed in the shape of a dome from tapered fire bricks which are set up in the traditional manner within an encircling structure such as a steel rim. The bricks possess considerable weight and, owing to the dome-shape in which they are arranged, they exert an outwardly directed force on the steel rim, causing substantial hoop stresses to develop within the rim. At ambient temperatures the rim can withstand these stresses, but the steel looses its strength at elevated temperatures, and since roof refractory bricks are exposed to the interior of the furnace, they become quite hot. So would the rim were it not for a water jacket that is incorporated into it. This, of course, maintains the temperature of the steel rim considerably less than that of the dome-shaped array of fire bricks which it contains—indeed at a temperature low enough to preserve the strength of the steel. The water jacket renders the roof more complex and adds appreciably to the cost of constructing and maintaining it.

Aside from the foregoing, a domed roof with its multitude of bricks, all in effect keyed together, is extremely difficult to repair. More often than not all of the brickwork must be reconstructed when only a small portion of it fails.

Cast roofs, that is roofs formed from castable refractories, are normally flat and do not require rims to contain them, but this type of roof construction has heretofore been installed only on fixed roof furnaces. Indeed, to construct such a roof, a form is erected within the furnace beneath an array of anchors which are suspended from beams. The refractory is then mixed and poured onto the form around the anchors. Once the refractory has set, the form is disassembled and removed through a clean-out door in the side of the furnace.

The present invention resides in a melting furnace having a removable roof provided with a castable refractory as well as in the process for constructing the roof.

DESCRIPTION OF THE DRAWINGS

In the accompanying drawings which form part of the specification and wherein like numerals and letters refer to like parts wherever they occur.

DETAILED DESCRIPTION

Figure 2:
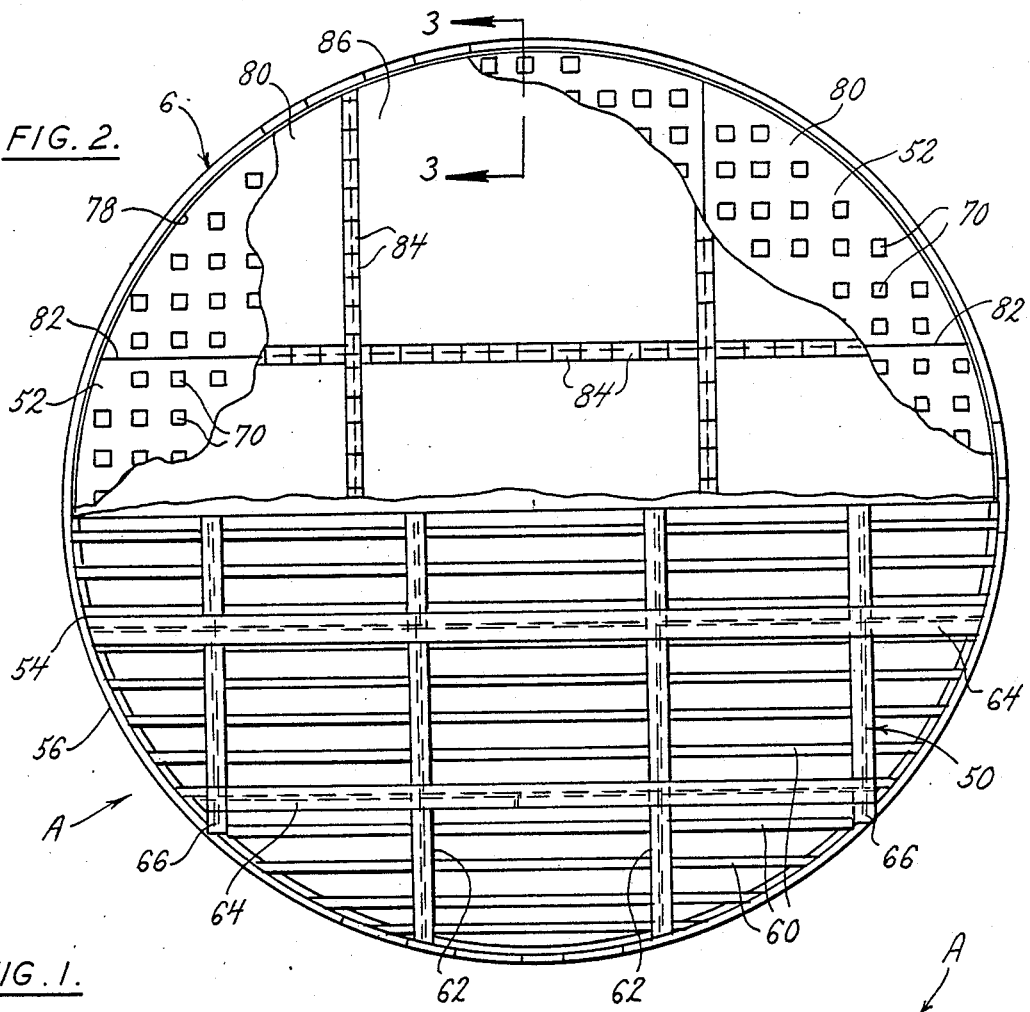
FIG. 2 is a plan view of the roof, partially broken away.
Figure 1:
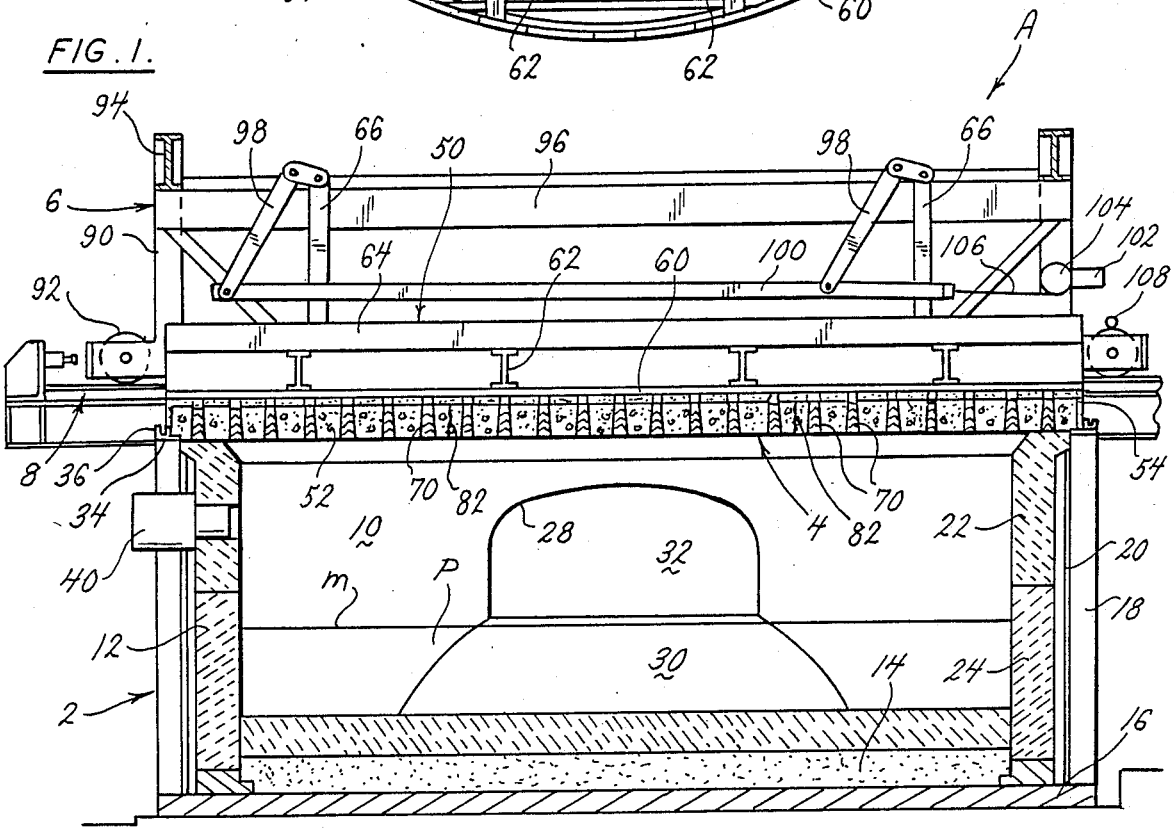
FIG. 1 is a sectional view in elevation of a furnace having a roof constructed in accordance with and embodying the present invention.
Figure 3:
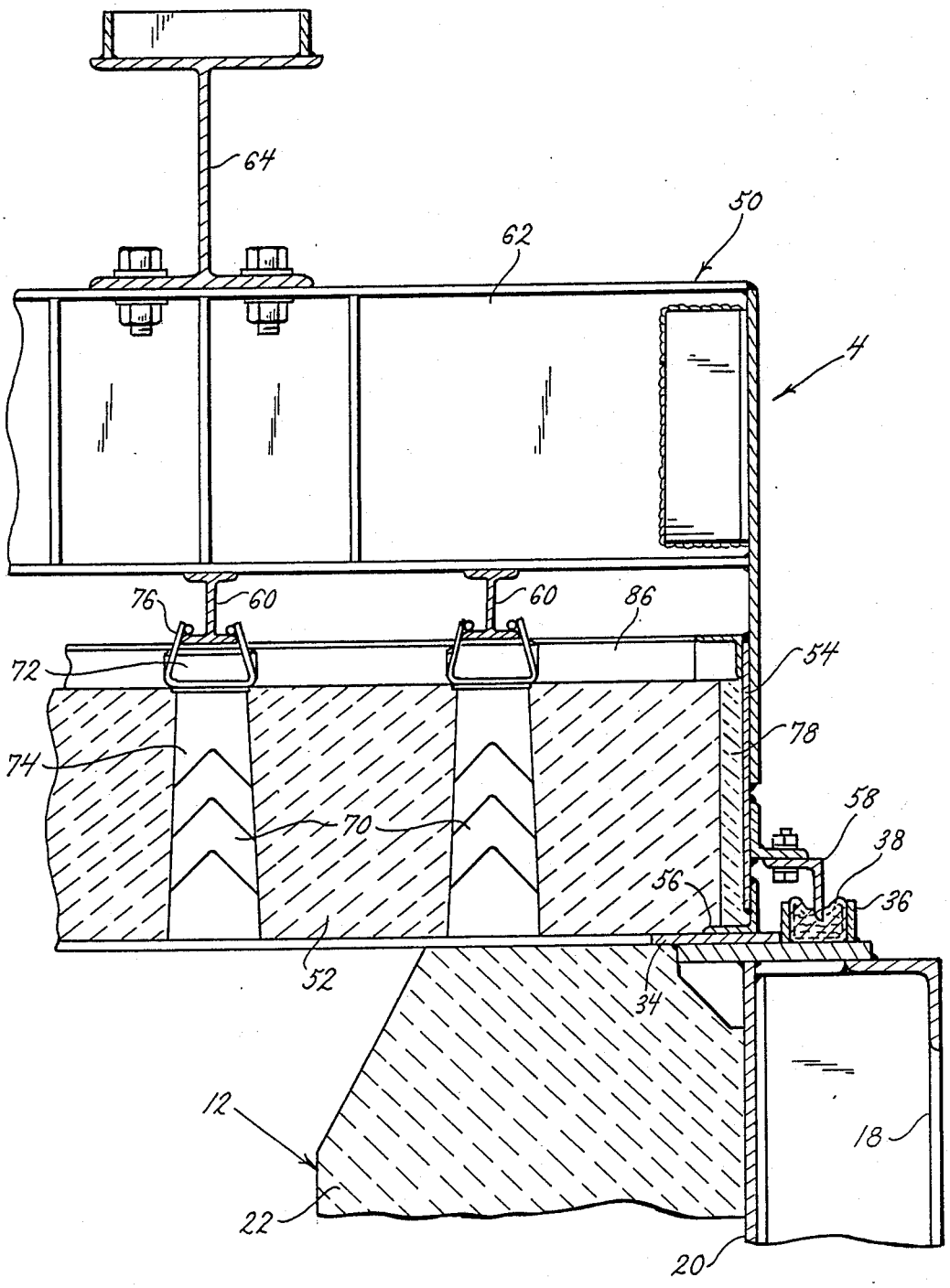
FIG. 3 is a sectional view taken along line 3—3 of FIG. 2 and showing the seal between the containment vessel and roof.

Referring now to the drawings, a furnace, which is suited for melting aluminum and other metals, contains within its interior a molten pool p of metal. This pool p is tapped from time to time and is further recharged at less frequent intervals with solid aluminum, such as aluminum scrap. This recharging occurs through the top of the furnace and may be effected with a large metal-handling device, such as a bucket or clam shell scoop, carried on an overhead crane. The furnace A basically includes a containment vessel 2 which holds the molten pool p, a roof 4 which fits over and closes the top of the containment vessel 2, yet may be removed to provide access to the vessel interior, a carriage 6 for lifting the roof 4 off of the containment vessel 2 and displacing it laterally, and rails 8 on which the carriage 6 moves. The upper surface of the pool p forms a metal line m which is located substantially below the roof 4 and above the metal line m that is between the line m and the roof 4. The vessel 2 and roof 4 enclose a chamber 10.

Considering the containment vessel 2 first, it basically includes a cylinderical side wall 12 and a generally flat floor 14 which rest on a steel base 16. The wall 12 and floor 14 serve to contain the pool p. The side wall 12, in turn, includes a steel shell 18 having a casing plate 20 of cylindrical configuration which is presented inwardly. In addition, the side wall 12 has a refactory lining consisting of an upper refractory 22 and a lower refractory 24. The former extends from the roof 4 downwardly to the latter which in turn extends all the way to the steel base 16. The juncture between the two refractories 22 and 24 lies somewhat above the melt line m, so that the pool p is contained entirely within the lower refractory 22 which is formulated to withstand molten metal of the pool p. The floor 14 likewise includes a refractory 24 which is presented upwardly toward the pool p where it is likewise exposed to the molten metal.

The side wall 12 contains an opening 28 which is located above the metal line m, and a ramp 30 which extends downwardly from the opening 28 to the floor 14. The shell 18 carries a door 32 which normally closes the opening 28, but may be displaced from it to afford access to the interior of the containment vessel 2. Both the ramp 28 and the door 30 are lined with a suitable refractory. At its upper end, the shell 18 is fitted with a seat 34 in the form of an annular plate, and the seat 34 provides a bearing surface on which the roof 4 rests. Outwardly from the seat 34 the shell 18 is fitted with an upwardly opening channel 36 which contains a resilient sealing material 38, such as a narrow strip of ceramic fibers.

Also, the side wall 12 in the region of its upper refractory 22 contains burners 40 which direct a flame into the chamber 10 located above the melt line m. The combustion keeps the interior of the vessel 2 hot enough to maintain the pool p in a molten condition.

Broadly speaking, the roof 4 comprises a framework 50 and a cast refractory 52 which is suspended from the framework 50 to form the closure for the upper end of the containment vessel 2. Like the containment vessel 2 which it covers, the roof 4 possesses a circular configuration, its diameter being about the same as the casing plate 20 on the shell 18 of the vessel 2. Indeed, the framework 50 possesses a circular band 54 which rests over the seat 34 of the shell 18 to form the periphery of the framework 50. The remainder of the framework 50 for the most part lies within the band 54, as does the refractory 52. Actually, the band 54 at its lower end is welded to angle member 56, which like the band 54, is rolled into a circle, and the angle member 56 has one flange located against the outside face of the band 54 and the other flange directed radially inwardly beneath the lower edge of the band 54. The radial flange of the angle member 56 in turn rests on the seat 34 at the upper end of the shell 18. In addition, the band 54 carries a downwardly directed lip 58 which is offset outwardly where it aligns with the channel 36. Indeed, when the angle member 56 on the lower end of the band 54 rests on the seat 34 of the shell 18, the lip 58 projects into the channel 36 and compresses the sealing material 38, thus effecting a good seal between the vessel 2 and roof 4.

Within the circular band 54, the framework 50 is arranged in several layers. The first of these layers, which is spaced from the bottom of the band 54 a distance corresponding to the thickness of refractory 52, consists of a series of parallel beams 60 which are relatively small in cross section and light in weight. Moreover, the beams 60 are spaced apart at relatively close intervals. Typically, 3 inch I-beams arranged on one foot centers will suffice for the beams 60 of the first layer. The beams 60 at their ends are cut to match the contour of the band 54, and here the beams 60 are welded to the inside face of the ban 54.

The next layer of the framework 50 constitutes more parallel beams 62, but they are heavier in cross section and fewer in number. The beams 62, while being parallel to each other, extend transversely with respect to the underlying beams 60, and thus cross the beams 60 at right angles. Here the beams 60 and 62 are joined together, the upper flanges of the lower beam 60 being welded to the lower flanges of the upper beams 62. Like the lower beams 60, the upper beams 62 are beveled at their ends to match the contour of the band 54, and here the beams 62 are welded to the inside face of the band 54, the upper flanges of the beams 62 being flush with the upper edge of the circular band 54.

The third layer of the framework 50 constitutes still more beams 64 which extend transversely with respect to the beams 62 and thus lie parallel to the small beams 60. The beams 64 are about the same size as the beam 62, but are fewer in number, and furthermore they are set above the upper edge of the circular band 54. Like the beams 62, the beams 64 are I-beams, and indeed the lower flanges of the beams 64 are attached to the upper flanges of the beams 62 with bolts. At least two of the top beams 64 have lifting posts 46 attached to them at two locations on each.

The refractory 52 is suspended from the beams 60 of the first layer and in essence forms a solid wall beneath those closely spaced beams, it being attached to the beams by refractory anchors 70 which are located along the beams 60 also at closely spaced intervals, typically on one foot centers. Each anchor 70 has an enlarged head 72 and a tapered body 74 which is extended from the head 72 and possesses its smallest diameter adjacent to the head 72. The head 72 fits against the underside of the lower flange on one of the beams 60 and is held against that beam by a clip 76 which receives the head 72 and fits over the sides of the lower flange for the beam 60. Thus, the anchors 70 depend from the beams 60 with the widest portions of their bodies 72 being presented downwardly. Indeed, the lower faces of the anchors 70 are flat and lie flush with the lower surface of the cast refractory 52. That surface in turn lies flush with the underside of the circular angle member 56 which is attached to the circular band 54. Since the anchors 70 are at their ends exposed to the intense heat within the containment vessel 2, they are likewise formed from a refractory material.

The refractory 52 surrounds the anchors 70 extending from the bottom faces of the anchor bodies 74 upwardly to the region of the heads 72. Moreover, it extends outwardly to a thin layer of block insulation 78 which lines the inside face of the band 54. Actually the refractory 52 is cast in sections and exists in separate sections which are separated by joints 82, the upper ends of which are covered by refractory bricks 84 which rest on the upper surface of the refractory 52. Over the remainder of the refractory 52 is a layer 86 of castable block mix, it extending no higher than about the upper surfaces of the anchor heads 72, which are of course at the lower surfaces of the flanges for the lower layer of beams 60. The layer 86 of castable block mix holds the bricks 84 in place.

The framework 50 for the roof 4 is constructed using conventional steel fabrication procedures. Indeed, the several layers of beams 60, 62 and 64 together with the band 54 and its angle member 56 may be laid up and joined together on a fabrication table having a flat upper surface. Initially, the framework 50 rests on the table with the horizontal flanges of the angle member 56 against the upper surface of the table, and as such the band 54 together with the table surface create a form to confine a refractory mix which is poured into that form. In this regard, the refractory 52 is derived from a granular refractory composition to which water is added to produce a plastic or moldable mix. Actually, only a minimal amount of water is added, so that the mix is quite thick and thus does not flow easily. This thick mix of refractory material is introduced into the void between the anchors 70, but only after narrow strips of aluminum have been suspended from the beams 60 where the joints 82 are desired. As the refractory mix flows into the regions delinated by the aluminum strips, the table is subjected to forceful vibrations which are transmitted to its upper surface as well as to the band 54 which is on that surface. The vibrations cause the mix to assume a more fluent consistency, and it flows between the anchors 70 and along the block insulation 78 to completely fill the voids between them. Enough of the mix is introduced to fill the form, that is the circular band 54 up to the heads 72 of the anchors 70, and after enough vibration has occurred to eliminate all air pockets within the plastic mix, the vibrators are shut off, and the mix is allowed to set up on the table. The mix hardens and keys into the anchors 70 to form the solid refractory 52. The joint bricks 84 are then placed over the edges of the aluminum strips at the joints 82 and the castable block mix 86 is applied over the top of the refractory 52, thus holding the bricks 84 in place. After the refractory 52 has cured for a sufficient duration, the completed roof 4 is lifted off of the table T with a crane and lowered over the containment vessel 2 until the angle member 56 at the lower end of its circular band 54 comes against the annular seat 34 at the upper end of the shell 18.

The two rails 8 exist at about the elevation of the refractory 52 in the roof 4 and ar spaced apart sufficiently to enable the containment vessel 2 to fit between them, which it does as does the roof 4. The rails 8 support the carriage 6, which rolls along them, and between the two rails 8 the carriage 6 straddles the roof 4. More specifically, the carriage 6 has two side frames 90, one above each rail 8, and these frames are fitted with wheels 92 which roll along the rails 8. The two side frames 90 are in turn connected with cross beams 94 which pass over the roof 2. Extended between the two cross beams 94 are intermediate beams 96 which lie parallel to the side frames 90 and adjacent to the lifting posts 66 of the framework 50 for the roof 4. The intermediate beams 96 carry bell cranks 98 which pivot on them, there being a bell crank 98 adjacent to each post 66 on the roof 4. Indeed, one end of each bell crank 98 is connected by means of a pivot pin to the end of one of the posts 66. The other arm of each bell crank 98 projects downwardly and is connected, again by a pivot pin to an operating rod 100 which extends horizontally over the roof 4. Actually, each rod 100 is connected to the depending arms of two bell cranks 98. At one end of the carriage 6 is a motor 102 which rotates two winches 104, each having a wire rope 106 wound around it, and the ropes 106 are connected to the ends of the operating rods 100. The arrangement is such that when the motor 102 is engaged to further wind the ropes 106 about their respective winches 104, the two rods 100 shift and rotate the bell cranks 98. The bell cranks 98 in turn lift the roof 4 upwardly, the force being applied at the four posts 66. The bell cranks 98 are configured to elevate the roof 4 far enough to bring its lower surface above the channel 36 at the upper end of the shell 18, that channel being the highest part of the containment vessel 2.

The carriage 6 also has another motor 108 which is connected to one of the wheels 92 so as to rotate that wheel. Assuming that the roof 4 is elevated, the carriage 6 will move along the rails 8 under the power of the motor 108. This displaces both the carriage 6 and the roof 4 to the side of the containment vessel 2 and thus exposes the open top of the containment vessel 2.

OPERATION

The furnace A maintains the pool p of metal that is within it in a molten condition, the heat required for sustaining the elevated temperature being supplied by the combustion of the combustible mixture that issues from the burners 40. While the burners 40 are operating, the roof 4 rests in its normal operating position atop the containment vessel 2. As such, the angle member 56 at the lower end of the circular band 54 for the roof 4 rests on and bears against the annular seat 34 at the upper end of the shell 18 for the containment vessel 2. The weight of the roof 4 is thus transmitted through the shell 18 to the steel base 16. In this condition the lip 58 along the circular band 54 of the roof 4 projects into the channel 36 at the upper end of the shell 18 and establishes a seal with the material 38 that is within the channel 36, thus producing a barrier which prevents hot gases from escaping from the interior of the containment vessel 2, both when the burners 40 are in operation and when they are not. Indeed, the burners 40 operate intermittently, and are energized merely long enough to sustain the interior of the containment vessel 2 at a temperature high enough to maintain the pool p in a molten condition.

The lower refractory 24 of the side wall 12 and the refractory 26 of the floor 14 contain the pool p and prevent it from significantly dissipating the heat that is within it. The upper refractory 26 for the side wall 12 and the refractory 52 for the roof 4, on the other hand, prevent significant loss of heat from the cavity 10 above the pool p, which cavity 10 is in effect a combustion chamber. The framework 50 supports the refractory 52 which is tied to that framework by the anchors 70. Since the refractory 52 is perfectly flat, it exerts no outwardly directed force, and thus the light weight circular band 54 is sufficient to enclose the side of the roof 4.

The pool p that is within containment vessel 2 is tapped from time to time, and therefore the metal which is withdrawn must be replenished. This is achieved by removing the roof 4 from the containment vessel 2, displacing it to the side of the vessel 2, and introducing solid metal into the pool p. Thereafter, the roof 4 is replaced and the burners 40 energized to provide the heat necessary to melt the charge of metal and to maintain the pool p in a molten condition.

To charge the furnace A, the burners 40 are first shut off. Then the motor 102 is energized such that the wire ropes 106 wind around their respective winches 104. The ropes 106 draw the operating rod 100 toward the winches 104, and the rods 100 in turn rotate the bell cranks 98 such that they lift the roof 4 away from the containment vessel 2. Indeed, the motor 102 remains energized long enough to raise the lower surface of the roof 4 above the channel 36 that extends along the upper edge of the shell 18. Once the roof 4 reaches this elevation, the motor 108 is energized, and it propels the carriage 6, and the roof 4 which is suspended from it, along the rails 8 until the roof 4 and carriage 6 are displaced to the side of the vessel 2. This exposes the interior of the vessel 2 and the pool p that is within it, and solid metal is merely dumped into the pool p.

When the pool p is fully charged, the carriage 6 returns over the rails 8 to its initial position, whereupon the motor 104 is again energized, but in the opposite direction, so that it allows the roof 4 to descend onto the seat 34 along the upper edge of the shell 18. As the roof 4 approaches its seated position, the sealing lip 58 along its circular band 54 enters the channel 36 and compresses the resiliant sealing material 38 in the channel 36.

Since the refractory 52 is suspended from the beams 60, 62 and 64 of the framework 50, the band 54 which surrounds the refractory 52 is essentially free of hoop stresses. It therefore requires no cooling channel, but instead is cooled by the surrounding air, and can be fabricated from relatively light weight steel. The beams 60, 62 and 64 which carry the refractory 52 are exposed almost entirely to the surrounding air, and while they experience a rise in temperature, the rise is not so great as to significantly weaken them.

Being cast the refractory 52 is much easier to repair than a refractory formed from bricks keyed into a dome-shaped configuration.

Whereas the containment vessel 2 and roof 4 as described and depicted are round, they may also be rectangular.

This invention is intended to cover all changes and modifications of the example of the invention herein chosen for purposes of the disclosure which do not constitute departures from the spirit and scope of the invention.

What is claimed is:

1. A furnace for melting metal, said furnace comprising: a containment vessel having a side wall and a floor for containing a pool of molten metal, and a roof normally closing the top of the containment vessel, but being separable from the containment vessel so that it can be removed as a unit from the containment vessel, the roof including a framework that extends across the top of the containment vessel and has a metal band along its periphery, anchors attached to the framework, and a refractory cast about and interlocked with the anchors within the confines of the band so that the anchors hold the refractory to the framework, the refractory being carried on the framework such that the refractory is presented downwardly and exposed to the interior of the containment vessel.

2. A furnace according to claim 1 wherein the framework includes a plurality of first beams and the anchors are attached to the first beams.

3. A furnace according to claim 2 wherein the framework includes a plurality of second beams which are fewer in number and stronger than the first beams, the second beams extending transversely over the first beams and being attached to the first beams.

4. A furnace according to claim 1 wherein the anchors are formed from a refractory material and extend vertically substantially through the refractory and are exposed at the bottom of the refractory.

5. A furnace according to claim 1 and further comprising means for lifting the roof off of the containment vessel and for displacing the roof to the side of the containment vessel.

6. In combination with a containment vessel for holding a pool of molten metal, the containment vessel having an open top and side walls which extend around the top and provide an upwardly presented bearing surface, an improved roof which normally rests on the bearing surface and closes the top of the containment vessel, but is removable as a unit from the containment vessel to expose the interior of the vessel, said roof comprising: a framework; anchors attached to the framework and depending from its; a refractory cast about the anchors and being presented downwardly; and a metal band attached to the framework and surrounding the refractory.

7. The combination according to claim 6 wherein the downwardly presented surface of the refractory is substantially flat.

8. The combination according to claim 6 wherein the framework includes a plurality of parallel first beams extended across substantially the entire width of the refractory and being straight, the anchors being attached to the first beams, and means for holding the first beams in fixed and determined relation to each other.

9. The combination according to claim 8 wherein the means for holding the first beams comprises second beams extending over the first beams transversely with respect to the first beams, the second beams being joined rigidly and securely to the first beams.

10. The combination according to claim 9 wherein the second beams are fewer in number than the first beams and are further of heavier construction.

11. The combination according to claim 10 wherein the framework further includes third beams extending transversely over the second beams and being rigidly attached to the second beams.

12. A furnace for melting metal, said furnace comprising: a containment vessel having a side wall and a floor for containing a pool of molten metal: and a roof normally closing the top of the containment vessel, but being removable from the containment vessel, the roof including a framework that extends across the top of the vessel, anchors attached to the framework, a refractory cast about and interlocked with the anchors so that the anchors hold the refractory to the framework, the refractory being carried on the framework such that the refractory is presented downwardly and exposed to the interior of the containment vessel, and a metal band surrounding the refractory, the band being exposed to and cooled essentially by ambient air which surrounds the furnace.

13. A furnace according to claim 12 and further comprising a layer of insulation between the refractory and the band.

14. A furnace according to claim 12 wherein the lower surface of the refractory is generally planar.

15. A furnace for melting metal, said furnace comprising: a containment vessel having a side wall and a floor for containing a pool of molten metal, and a roof normally closing the top of the containment vessel, but being separable from the containment vessel so that it can be removed as a unit from the containment vessel, the roof including a framework that extends across the top of the containment vessel and includes a plurality of first beams and a plurality of second beams which are fewer in number and stronger than the first beams, the second beams extending transversely over the first beams and being attached to the first beams, and a band which at its periphery, anchors attached to the first beams of the framework; and a refractory cast about and interlocked with the anchors within the confines of the band, so that the anchors hold the refractory to the framework, the refractory being carried on the framework such that the refractory is presented downwardly and exposed to the interior of the containment vessel.

16. A furnace according to claim 15 wherein the band is exposed to and cooled essentially by air which surrounds the furnace.

17. In combination with a containment vessel for holding a pool of molten metal, the containment vessel having an open top and side walls which extend around the top and provide an upwardly presented bearing surface, an improved roof which normally rests on the bearing surface and closes the top of the containment vessel, but is removable as a unit from the containment vessel to expose the interior of the vessel, said roof comprising: a framework; anchors attached to the framework and depending from it; and a refractory cast about the anchors and being presented downwardly, the framework including a plurality of parallel first beams extended across substantially the entire width of the refractory and being straight, the anchors being attached to the first beams, second beams extending over the first beams transversely with respect to the first beams, the second beams being joined rigidly and securely to the first beams for holding the first beams in fixed and determined relation to each other, the second beams being fewer in number than the first beams and of heavier construction, and a band extended around the periphery of the roof and obscuring the sides of the refractory.

18. The combination according to claim 17 wherein the band carries a bearing member and the roof rests on the bearing surface of the containment vessel along the bearing member of the roof.

19. The combination according to claim 17 wherein the band on the framework of the roof is exposed to and cooled essentially by air which surrounds the vessel and roof.

20. A process for constructing the roof of a furnace for melting metal, said process comprising constructing a framework having cross members; placing the framework over a horizontal surface with the cross members spaced from the surface; placing a metal band around the space between the cross members and the surface at the periphery of the framework; attaching anchors to the framework such that the anchors are in the space between the framework and the horizontal surface and within the confines of the metal band; pouring a moldable refractory mix onto the horizontal surface within the confines of the metal band and around the anchors; vibrating the horizontal surface to cause the moldable mix to flow over the surface and around the anchors; and allowing the refractory mix to set up into a solid refractory that is interlocked with the anchors.

21. The process according to claim 20 wherein the anchors are attached to the cross members of the framework.

* * * * *